US005211481A

United States Patent [19]

Tilman

[11] Patent Number: 5,211,481

[45] Date of Patent: May 18, 1993

[54] CLOSURE FOR SLIDERLESS ZIPPER BAGS

[75] Inventor: Paul A. Tilman, New City, N.Y.

[73] Assignee: Minigrip, Inc., Orangeburg, N.Y.

[21] Appl. No.: 984,020

[22] Filed: Nov. 30, 1992

Related U.S. Application Data

[63] Continuation of Ser. No. 797,461, Nov. 22, 1991, abandoned.

[51] Int. Cl.[5] ..... B65D 33/24

[52] U.S. Cl. ..... 383/63; 24/587

[58] Field of Search ..... 383/63, 65; 24/576, 24/587, 588, 578

[56] References Cited

U.S. PATENT DOCUMENTS 3,372,442 3/1968 Ishimatsu ..... 383/63 X
3,416,199 12/1968 Imamura ..... 383/63 X
4,672,723 6/1987 Hugues et al. ..... 383/63 X
4,710,968 12/1987 Borchardt et al. ..... 383/63
4,778,282 10/1988 Borchardt et al. ..... 383/63
4,929,487 5/1990 Tilman et al. ..... 383/65 X

*Primary Examiner*—Stephen P. Garbe
*Assistant Examiner*—Jes F. Pascua
*Attorney, Agent, or Firm*—Kane, Dalsimer, Sullivan, Kurucz, Levy, Eisele and Richard

[57] ABSTRACT

A reclosable bag is formed of walls defining a closure with a mouth. Adjacent to the mouth the bag is formed with interlocking male and female profiles for selectively opening and closing the mouth. Beams are also provided on the inner surfaces of the walls positioned to insure that the male and female profiles do not open inadvertently. Finger guide members may also be provided above the profiles to insure that the bag is closed properly.

16 Claims, 2 Drawing Sheets

CLOSURE FOR SLIDERLESS ZIPPER BAGS

This is a continuation of copending application Ser. No. 07/797,461 filed on Nov. 22, 1991, now abandoned.

BACKGROUND OF THE INVENTION

A. Field of Invention

This invention pertains to the art of extruded reclosable bags and more particularly to a reclosable bag having fastener profiles with finger guides for interlocking the profiles and secondary closure means for insuring that the interlocked profiles do not open inadvertently.

B. Description of the Prior Art

Reclosable bags used for example for storing household goods are typically made of polyethylene. As shown in U.S. Pat. No. 3,416,199 to Imamura commonly assigned with the present invention, a reclosable bag may be formed of two opposed walls equipped at the mouth with fastener profiles. These profiles include a male profile attached to one wall and a female profile on the other wall. The profiles are shaped so that when they are aligned and pressed together into an engaging relationship they form a continuous closure for the bag. The bag may be opened by pulling the walls apart thereby separating the profiles. Various geometric shapes and arrangements for such profiles are shown in Re. U.S. Pat. Nos. 28,969; 3,323,707; 4,212,337; 4,363,345; 4,561,108; and 4,812,056. In addition U.S. Pat. Nos. 4,736,496 and 5,012,561 disclose reclosable bags with profiles and internal ribs adjacent to the profiles. U.S. Pat. No. 4,822,539 discloses a reclosable bag with interlocking profiles, internal guiding ribs disposed adjacent to the profiles, and stabilizing beams disposed on an outside surface of the bag wall. U.S. Pat. No. 3,338,285 discloses a reclosable bag having several parallel interlocking male and female profiles. In general, the profiles must be such as to provide relatively high resistance to opening from inside the bag while rendering the bag relatively easy to open from the outside.

One problem with the prior art reclosable bags is that their closures are sometimes not strong enough to hold large or heavy articles, and as a result the profiles may separate inadvertently during use. A further problem is that it is sometimes difficult to close such bags particularly large bags where the fingers of a user may drift off the profiles resulting in the closing pressure not being directly applied to portions of the closures.

SUMMARY OF THE INVENTION

In view of the above, an objective of the present invention is to provide a reclosable bag with improved closure means resistant to inadvertent opening.

A further objective is to provide a reclosable bag with guide means which guide the fingers of user when closing the bag whereby the bag can be easily and securely closed.

Other objectives and advantages of the invention will become apparent from the following description. A reclosable bag constructed in accordance with this invention includes a front wall and a rear wall joined to form an enclosure with a mouth defined by wall edges at the top of the bag and male and female profile means for selectively opening and closing said mouth. The male and female profile means form a primary closure for the bag. Secondary closure means are provided to maintain the primary closure means in a closed position and to prevent the inadvertent opening. The bag may also include guide means disposed opposite to the profile means for guiding a user's fingers along the profile means. Advantageously the guides also define hinging regions for the secondary closure means.

DETAILED DESCRIPTION OF THE INVENTION

Figure 1:
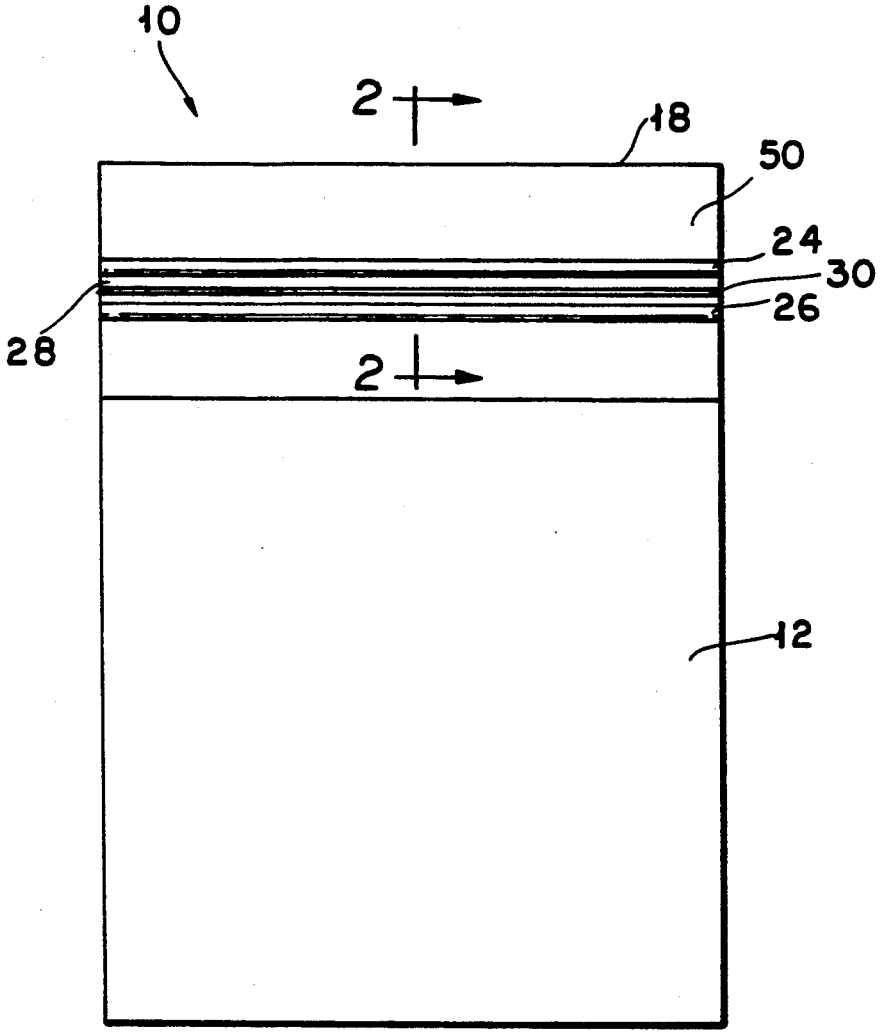
FIG. 1 shows a plan view of a reclosable bag constructed in accordance with the invention.
Figure 2:
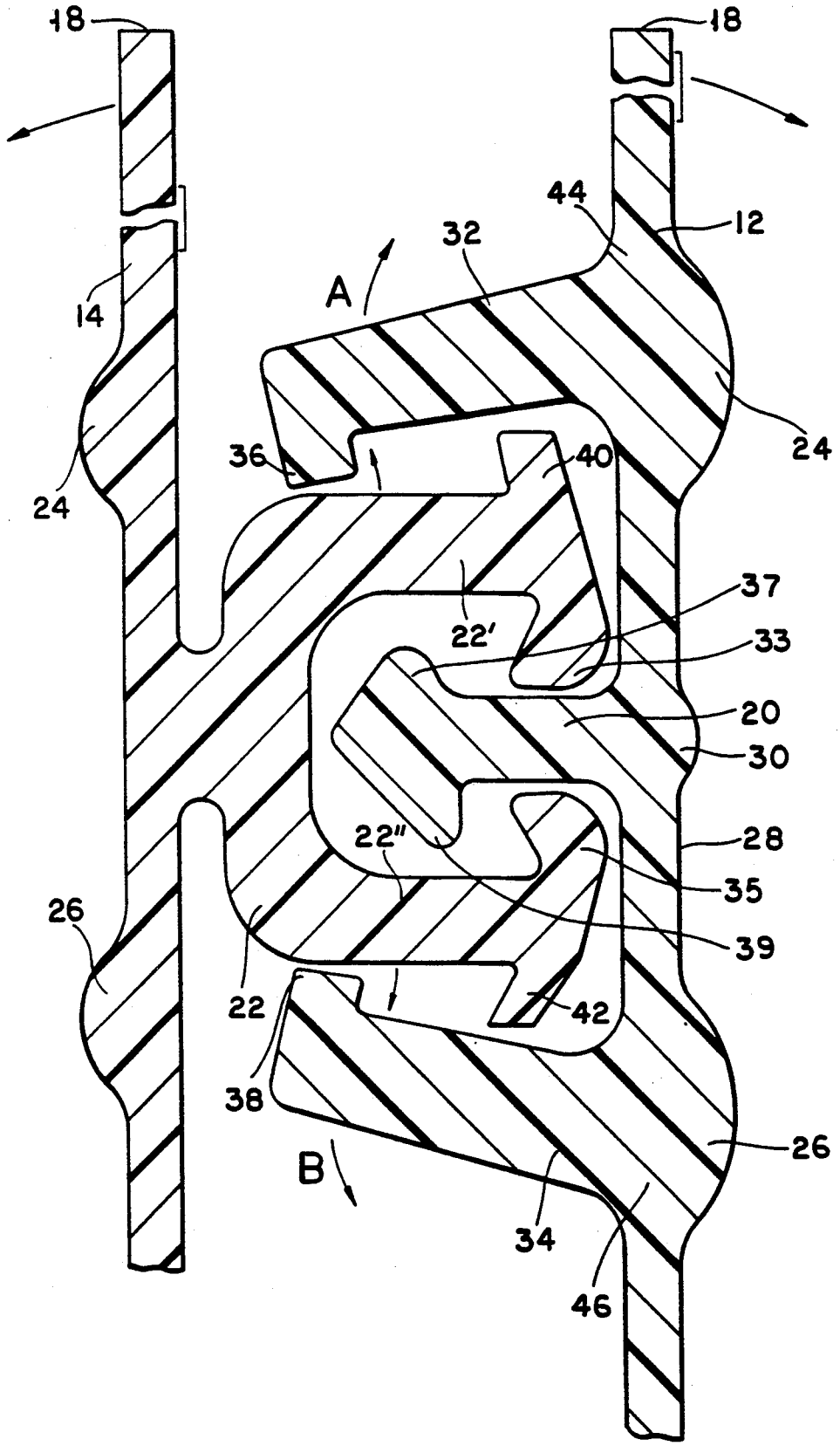
FIG. 2 shows an enlarged side sectional view of the bag opening.

Referring now to the drawings, a reclosable bag 10 constructed in accordance with this invention includes front and rear walls 12, 14 seamed along three edges thereby forming an enclosure with an opening or mouth 16 along the top or fourth edge 18. The bag 10 is preferably made of a thermoplastic material such as polyethylene by extrusion. Attached to internal faces, walls 12 and 14 are male and female profiles 20, 22 respectively which extend continuously from side to side of the bag. The profile serves to close the bag opening 16 when they are interlocked as shown in FIG. 2.

On the outside face of wall 12 two ribs 24, 26 are located, and placed parallel to member 20 to thereby define a valley 28 disposed behind member 20. A third rib 30 much smaller than ribs 24, 26 is disposed in valley 28, directly behind male profile 20 and serves to provide a stabilizer for male member 20.

The spacing between ribs 24 and 26 and the sizing of ribs 24, 26 and 30 is such that valley 28 is sized and shaped to act as a finger guide for the end user of the bag 10. Thus, as the user passes his finger in the valley the user's finger is directed towards the optimum position for applying pressure for forcing the profiles 20, 22 together and insure that the profiles interlock properly across the entire width of the bag. Male profile 20 and female profile 22 are of the asymmetric arrowhead construction disclosed in Re. U.S. Pat. No. 28,969 and serve to form the primary closure means for bag 10. However, whereas the conventional female profile includes only internally directed hooks 33,35 extending from arms 22' and 22'' for engagement with the internally directed barbs 37,39 of the conventional male arrowhead profile, the female profile 22 of the present invention also includes externally directed hooks 40,42 extending from arms 22' and 22''. In addition, two parallel beams 32, 34 are provided on each side of male profile 20, extending from the internal face of wall 12. These beams 32, 34 have a generally L-shaped cross-section terminating in short latching hooks or stubs 36, 38 respectively which are generally parallel to wall 12 but are slightly angled. The purpose of these beams 32, 34 is to limit the movement of the arms 22', 22'' of female profile 22. Preferably stub 42 is angled slightly with respect to stub 38, whereas stubs 40 and 36 are generally parallel as shown in FIG. 2. Stubs 40, 42 cooperate with beams 32, 34 to form an interlocking interconnection when snapped together to provide a secondary closure means for bag 10. In this connection, as with the primary closure means the secondary closure means is asymmetric resulting from the taper to stud 42 so that a greater disengagement force is required to be applied on the inside of the bag than is required to be applied on the outside of the bag to disengage the secondary closure.

In this manner, the resistance to inadvertent opening of the bag from the inside is enhanced.

Bag 10 is normally opened by gripping edges 18, 18' on the outside of the bag and pulling them apart. This action causes beams 32 and 34 to pivot away from the female profile 22, as shown by arrows A and B thereby disengaging the secondary closure and also separates the barbs 37,39 of the male arrowhead member from the stubs 33,35 of the female member allowing the female member 22 to disengage from the male member 20. Importantly ribs 24 and 26 define hinging zones 44, 46 on wall 12 which allow the beams 32,34 to pivot easily to enable the action described above.

Bag 10 may be generated unitarily for example by extruding the walls of the bag 12, 14, the profiles 20, 22, the ribs 24, 26, 30 and beams 32, 34 integrally as shown in FIG. 2. Alternatively the closures may be provided as strips 50 to be bonded to sheets of bag forming material at some stage in the bag forming operation.

Obviously numerous modifications may be made to this invention without departing from their scope as defined in the appended claims.

I claim:

1. A reclosable bag comprising:

a first wall and a second wall joined to form an enclosure with a mouth defined by wall edges;

a primary closure for selectively opening and sealing said mouth, said primary closure comprising an asymmetric arrowhead male profile extending along an internal surface of said first wall and a female profile having stubs adapted to interengage with said male profile and extending along an internal surface of said second wall; and a secondary closure for selectively opening and sealing said mouth including first and second beams dependent from said first wall internal surface and positioned outboard of said female profile, said beams having portions adapted to interengage with asymmetric outwardly extending portions of said female profile whereby to capture said female profile therebetween and restrict said female profile.

2. The reclosable bag of claim 1 wherein said beams include transverse stubs extending toward said male profile.

3. The reclosable bag of claim 2 wherein said stubs are angled toward said first wall.

4. The reclosable bag of claim 2 wherein said secondary closure means further includes transverse stub elements on said female profile extending away from said male profile toward said bag mouth and the interior of said bag, said female profile stub element being adapted to interengage with said beams transverse stubs.

5. The reclosable bag of claim 4 wherein said female profile stubs are angled toward said second wall, the stub directed toward the bag interior being more sharply angled than the stub directed toward the bag mouth whereby a greater disengagement force is required to disengage the secondary closure from said bag interior than from its exterior.

6. The reclosable bag of claim 1 further comprising guide means disposed on at least one of said walls for guiding the fingers of a user in closing said bag.

7. The reclosable bag of claim 6 wherein said guide means includes a pair of spaced apart guide members disposed on an external surface of said first wall on opposite sides of said male profile.

8. The reclosable bag of claim 7 wherein said pair of guide members defines a valley therebetween disposed opposite to said male profile.

9. The reclosable bag of claim 1 wherein said primary and secondary closure means are disposed on a strip, said strip being attached to said walls.

10. The reclosable bag of claim 1 wherein said primary and secondary closure means are formed unitarily with said walls.

11. A recloseable bag comprising:

a first wall and a second wall joined to form an enclosure with a mouth defined by wall edges;

primary and secondary closures on internal surfaces of said walls for selectively opening and sealing said mouth; and guide means disposed on an external surface of at least one of said walls opposite to said closure means for guiding a user's fingers along said closures while engaging said closures to seal said bag.

12. The reclosable bag of claim 11 wherein said primary closure includes a male profile depending from an internal surface of said first wall and a female profile depending from an internal surface of said second wall, and said secondary closure includes at least one beam depending from said first wall and positioned outboard of said female profile to limit lateral movement of said female profile.

13. The reclosable bag of claim 11 wherein said guide means includes a pair of ribs disposed on an outer surface of said first wall.

14. The reclosable bag of claim 13 wherein said closure means includes a male profile depending from said first wall and disposed between said ribs, and a female profile depending from said second wall and cooperating with said male profile to seal said bag.

15. The reclosable bag of claim 14 wherein said closure means further includes a beam depending from said first wall and positioned to limit lateral movement of said female profile.

16. The reclosable bag of claim 15 wherein one of said ribs is arranged to form a hinging zone on said first wall for said beam, whereby when said walls are separated to open said bag, said beam pivots at said hinging zone to permit said male and female profiles to disengage.

* * * * *